US007166019B2

(12) United States Patent
Park et al.

(10) Patent No.: US 7,166,019 B2
(45) Date of Patent: Jan. 23, 2007

(54) FLEXIBLE MEMBRANE FOR A POLISHING HEAD AND CHEMICAL MECHANICAL POLISHING (CMP) APPARATUS HAVING THE SAME

(75) Inventors: Moo-Yong Park, Yongin-si (KR); Ja-Eung Koo, Goyang-si (KR); Sang-Cheol Han, Seoul (KR); Duk-Ho Hong, Goyang-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 114 days.

(21) Appl. No.: 11/044,373

(22) Filed: Jan. 27, 2005

(65) Prior Publication Data

US 2005/0176354 A1 Aug. 11, 2005

(30) Foreign Application Priority Data

Feb. 9, 2004 (KR) ..... 10-2004-0008267

(51) Int. Cl.
*B24B 49/00* (2006.01)

(52) U.S. Cl. ..... 451/287; 451/285; 451/41; 451/290; 451/398; 279/3

(58) Field of Classification Search ..... 451/8, 451/9, 41, 285–290, 385, 388, 397, 398; 279/3

See application file for complete search history.

(56) References Cited

U.S. PATENT DOCUMENTS 5,851,140 A * 12/1998 Barns et al. ..... 451/288
5,916,015 A * 6/1999 Natalicio ..... 451/288
5,957,751 A * 9/1999 Govzman et al. ..... 451/8
6,033,292 A * 3/2000 Inaba ..... 451/288
6,036,587 A * 3/2000 Tolles et al. ..... 451/288
6,050,882 A * 4/2000 Chen ..... 451/41

(Continued)

FOREIGN PATENT DOCUMENTS

JP 2003-031531 1/2003

(Continued)

OTHER PUBLICATIONS

European Patent Office Communication.

*Primary Examiner*—Lee D. Wilson
*Assistant Examiner*—Anthony Ojini
(74) *Attorney, Agent, or Firm*—F.Chau & Associates, LLC

(57) ABSTRACT

A flexible membrane for a polishing head and a chemical mechanical polishing (CMP) apparatus having the same are provided. The flexible membrane for a polishing head includes a compressing plate having a first face and a second face opposite to the first face. The first face of the compressing plate holds a substrate with a vacuum provided thereto and compresses the substrate on a polishing pad. The second face of the compressing plate is combined with a supporter of the polishing head. The second face and the supporter define a space to which the vacuum for holding the substrate and a first pneumatic pressure for compressing the substrate are applied. A dividing member combined with the supporter is formed on the second face. The dividing member divides the space into at least two regions. A pneumatic pressure-introducing portion is formed at the dividing member. A second pneumatic pressure is provided to the compressing plate through the pneumatic pressure-introducing portion.

20 Claims, 8 Drawing Sheets

U.S. PATENT DOCUMENTS

| | | | | |
|---|---|---|---|---|
| 6,273,803 | B1 * | 8/2001 | Wang et al. | 451/288 |
| 6,273,804 | B1 * | 8/2001 | Numoto | 451/288 |
| 6,277,000 | B1 * | 8/2001 | Gotcher | 451/41 |
| 6,277,014 | B1 * | 8/2001 | Chen et al. | 451/398 |
| 6,361,420 | B1 * | 3/2002 | Zuniga et al. | 451/288 |
| 6,447,379 | B1 | 9/2002 | Gromko et al. | 451/287 |
| 2002/0039879 | A1 | 4/2002 | Zuniga et al. | 451/288 |
| 2002/0111122 | A1 | 8/2002 | Korovin et al. | 451/41 |

FOREIGN PATENT DOCUMENTS

| | | | |
|---|---|---|---|
| KR | 1020020040529 | A | 5/2002 |
| WO | WO 01/74534 | A2 | 10/2001 |
| WO | WO 02/07931 | A2 | 1/2002 |

* cited by examiner

1000

FLEXIBLE MEMBRANE FOR A POLISHING HEAD AND CHEMICAL MECHANICAL POLISHING (CMP) APPARATUS HAVING THE SAME

CROSS REFERENCE TO RELATED APPLICATION

This application claims priority under 35 U.S.C. § 119 to Korean Patent Application No. 2004-8267, filed on Feb. 9, 2004, the contents of which are herein incorporated by reference in its entirety for all purposes.

FIELD OF THE INVENTION

The present invention relates to a flexible membrane for a polishing head and a chemical mechanical polishing (CMP) apparatus having the same, and more particularly, to a flexible membrane for a polishing head that holds a substrate using a vacuum and compresses the substrate on a polishing pad of the polishing head, and an apparatus for chemically and mechanically polishing the substrate using the flexible membrane.

DESCRIPTION OF THE RELATED ART

As recent semiconductor devices have become highly integrated, the wiring therein has become multi-layered. Thus, a step difference between surfaces of unit cells that are stacked on a semiconductor substrate has gradually increased. To reduce the step difference between the surfaces of the unit cells, a chemical mechanical polishing (CMP) method is often used to polish a surface of the substrate such as by using a polishing pad with slurry applied to the surface of the substrate.

A CMP apparatus for performing the CMP method is disclosed in Korean Patent Laid Open Publication No. 2002-0040529. FIG. 1 shows a CMP apparatus disclosed in the Publication.

Referring to FIG. 1, the CMP apparatus includes a platen 2 disposed on a station 1. A motor (not shown) disposed in the station 1 rotates the platen 2. A polishing pad 3 for polishing a substrate is attached to a surface of the platen 2. A slurry line 7 for providing slurry to a surface of the polishing pad 3 is mounted on the station 1. In addition, a pad conditioner 8 for removing foreign substances from the polishing pad 3 is installed on the station 1.

A polishing head 4 for compressing the substrate on the polishing pad 3 is disposed over the platen 2. The polishing head 4 is connected to a motor 5 via a shaft 6. The polishing head 4 is rotated in a direction opposite that of a rotational direction of the platen 2. The polishing head 4 holds the substrate with a vacuum provided thereto and places the substrate on the polishing pad 3. In addition, the polishing head 4 compresses the substrate with a pneumatic pressure provided thereto to closely adhere the substrate to the polishing pad 3. Thus, a vacuum line (not shown) for providing the vacuum to the polishing head 4 is connected to the polishing head 4. In addition, a pneumatic pressure line (not shown) for providing the pneumatic pressure to the polishing head 4 is connected to the polishing head 4.

The polishing head 4 includes a carrier (not shown) connected to the vacuum line and the pneumatic pressure line, a supporter (not shown) disposed in the carrier, a flexible membrane (not shown) for holding the substrate with the vacuum, and a retainer ring for preventing the substrate held on the flexible membrane from being detached.

The flexible membrane includes a compressing plate having a circular shape. A sidewall is formed on an edge portion of the compressing plate. A partition wall for defining a region to which the vacuum is applied is formed on a central portion of the compressing plate.

When a surface of the substrate held on the flexible membrane is compressed and polished on the polishing pad, the surface of the substrate is polished to a uniform thickness. To uniformly polish the surface of the substrate, a uniform pressure is applied from the flexible membrane to the entire substrate.

However, because the flexible membrane is divided into a vacuum region and a pressure region, the pressure is not always uniformly applied to the whole substrate. Therefore, when a layer on the substrate is polished, the polishing speeds between the vacuum and pressure regions of the layer are different.

The non-uniform polishing speeds cause the substrate to be non-uniformly polished. Thus, the surface of the substrate may not be planarized giving the substrate an uneven surface. For example, the central portion of the substrate is typically thinned which is also known as dishing. As a result, it may be difficult to form additional layers on the uneven surface of the substrate.

A need therefore exists for a flexible membrane for use with a polishing head that is capable of uniformly compressing a substrate and a CMP apparatus having the flexible membrane.

SUMMARY OF THE INVENTION

A flexible membrane for a polishing head in accordance with one aspect of the present invention includes a compressing plate having a first face and a second face opposite to the first face. The first face of the compressing plate holds a substrate with a vacuum provided thereto and compresses the substrate on a polishing pad. The second face of the compressing plate is combined with a supporter of the polishing head. The second face and the supporter define a space to which the vacuum for holding the substrate and a first pneumatic pressure for compressing the substrate are applied. A dividing member combined with the supporter is formed on the second face. The dividing member divides the space into at least two regions. A first pneumatic pressure-introducing portion is formed at the dividing member. A second pneumatic pressure is provided to the compressing plate through the first pneumatic pressure-introducing portion.

A flexible membrane for a polishing head in accordance with another aspect of the present invention includes a compressing plate having a first face and a second face opposite to the first face. The first face of the compressing plate holds a substrate with a vacuum provided thereto and compresses the substrate on a polishing pad. A sidewall is formed on an edge portion of the second face. The sidewall is combined with a supporter of the polishing head. The sidewall and the supporter define a space. A dividing member is formed on the second face. The dividing member divides the space into main pressure regions to which main pneumatic pressures different from each other are provided. Auxiliary pressure region-forming members combined with the supporter are formed on the dividing member and the sidewall. The auxiliary pressure region-forming members and the supporter define auxiliary pressure regions to which an auxiliary pneumatic pressure is provided. Pneumatic pressure-introducing portions are formed at the partition wall and the sidewall. The auxiliary pneumatic pressure is provided to the compressing plate through the pneumatic pressure-introducing portions.

A chemical mechanical polishing (CMP) apparatus in accordance with still another aspect of the present invention includes a platen having a pad for polishing a substrate, a flexible membrane for holding and compressing the substrate, and a polishing head having a supporter for supporting the flexible membrane. The flexible membrane includes a compressing plate having a first face and a second face opposite to the first face. The first face of the compressing plate holds the substrate with a vacuum provided thereto and compresses the substrate on the polishing pad. The second face of the compressing plate is combined with the supporter. The second face and the supporter define a space to which the vacuum for holding the substrate and a first pneumatic pressure for compressing the substrate are applied. A dividing member combined with the supporter is formed on the second face. The dividing member divides the space into at least two regions. A first pneumatic pressure-introducing portion is formed at the dividing member. A second pneumatic pressure is provided to the compressing plate through the first pneumatic pressure-introducing portion.

BRIEF DESCRIPTION OF THE DRAWINGS

The above objects of the present invention will become more apparent by describing in detail preferred embodiments thereof with reference to the attached drawings in which.

DESCRIPTION OF THE PREFERRED EMBODIMENTS

Figure 1:
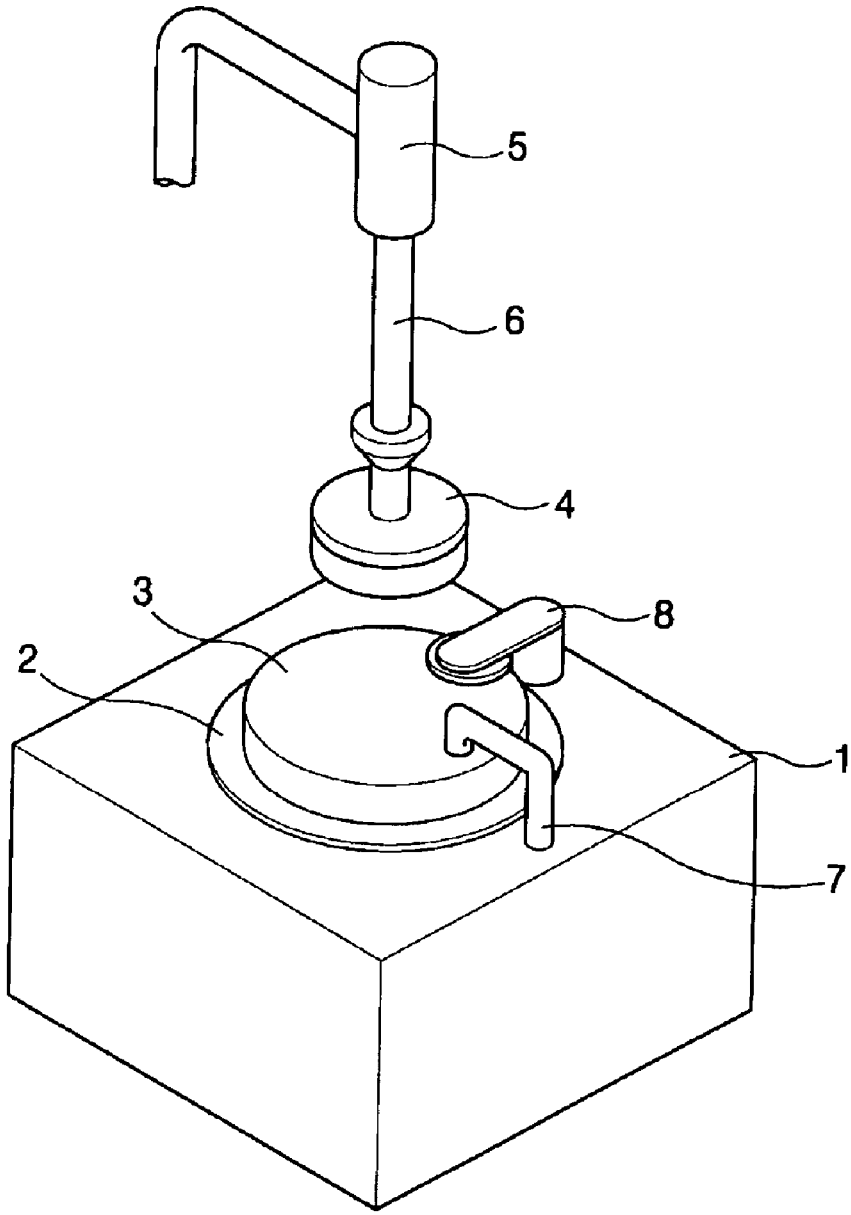
FIG. 1 (PRIOR ART)
FIG. 1 is a perspective view illustrating a conventional chemical mechanical polishing (CMP) apparatus.
Figure 2:
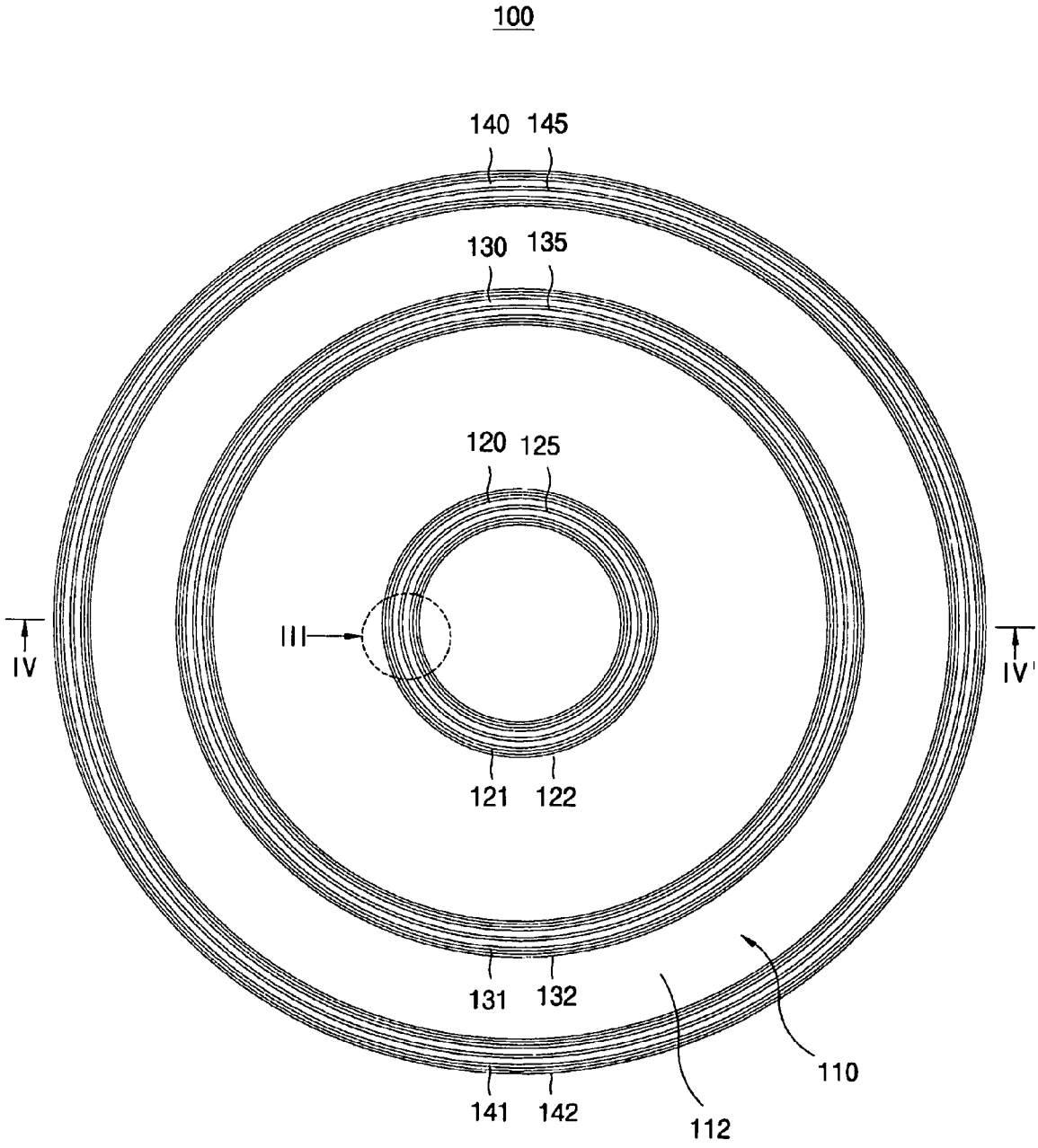
FIG. 2 is a plan view illustrating a flexible membrane in accordance with a preferred embodiment of the present invention.
Figure 3:
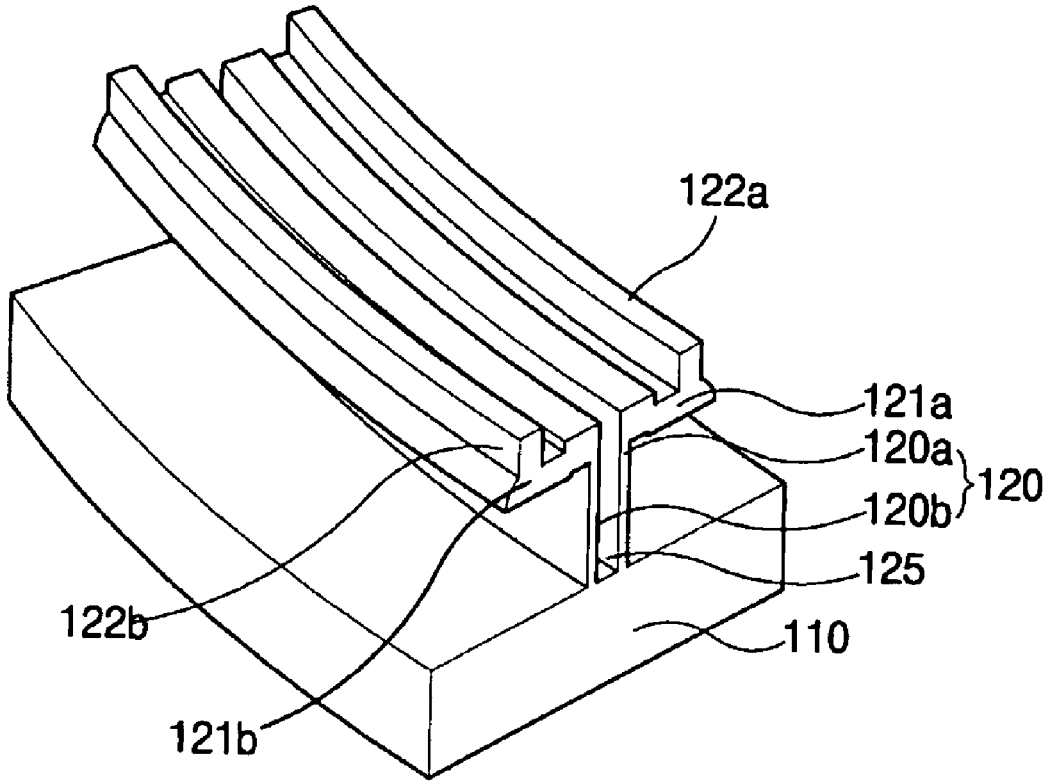
FIG. 3 is an enlarged perspective view of portion III of FIG. 2.
Figure 4:
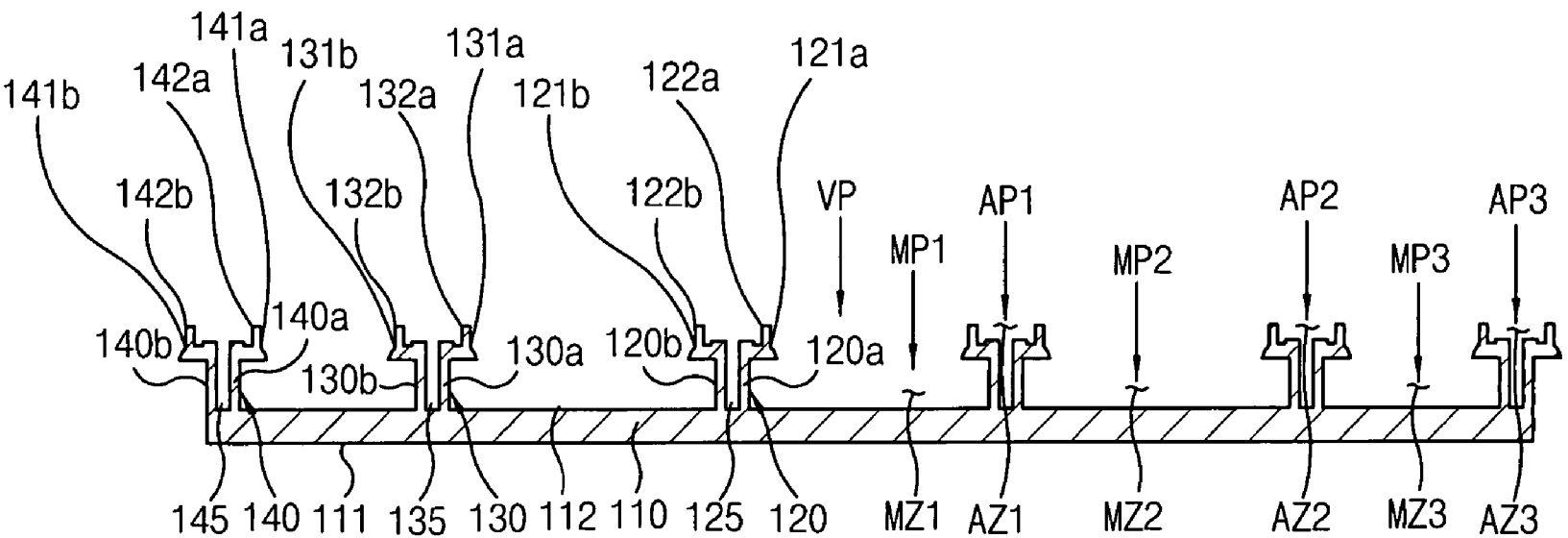
FIG. 4 is a cross sectional view along line IV–IV' of FIG. 2.

FIG. 2 is a plan view illustrating a flexible membrane in accordance with a preferred embodiment of the present invention, FIG. 3 is an enlarged perspective view of portion III of FIG. 2, and FIG. 4 is a cross sectional view along line IV–IV' of FIG. 2.

Referring to FIGS. 2 through 4, a flexible membrane 100 includes a compressing plate 110, first and second partition walls 120 and 130 formed on the compressing plate 110, a sidewall 140 formed on the compressing plate 110, and slots 125, 135 and 145 formed on the first and second partition walls 120 and 130 and the sidewall 140. The first and second partition walls 120 and 130 correspond to a dividing member. In addition, each of the slots 125, 135 and 145 correspond to a pneumatic pressure-introducing portion for introducing a pneumatic pressure. The flexible membrane 100 is combined with a supporter (not shown) of a polishing head (not shown). The flexible membrane 100 holds a substrate with a vacuum VP provided thereto. Examples of the flexible membrane 100 include a rubber such as an ethylene propylene rubber, a neoprene rubber, a nitrile rubber, etc.

The compressing plate 110 has a circular shape. However, the shape of the compressing plate 110 may vary in accordance with an object to be polished. Thus, when the object is a wafer having a circular shape, the compressing plate 110 has the circular shape. On the contrary, when the object is a rectangular glass used, for example, in a liquid crystal display (LCD) device, the compressing plate 110 may have a rectangular shape.

The compressing plate 110 has a first face 111, and a second face 112 opposite to the first face 111. The first face 111 is oriented in a downward direction where a polishing pad (not shown) is disposed. The second face 112 is oriented in an upward direction. The substrate is held onto the first face 111 by the vacuum VP. The vacuum VP for holding the substrate and the pneumatic pressure for closely adhering the substrate to the polishing pad are selectively provided to the second face 112.

The sidewall 140 is formed on an edge portion of the second face 112. Thus, the sidewall 140 has an annular shape. The sidewall 140 is combined with the supporter. The sidewall 140 and the supporter define an isolated space over the second face 112.

The dividing member includes the first and second partition walls 120 and 130 having a height substantially identical to that of the sidewall 140 and also having an annular shape. The first partition wall 120 is disposed on a central portion of the second face 112. The first partition wall 120 is combined with the supporter to define a vacuum region MZ1 into which the vacuum VP and a first main pneumatic pressure MP1 are selectively introduced.

The second partition wall 130 is disposed between the first partition wall 120 and the sidewall 140. Thus, the first and second partition walls 120 and 130 and the sidewall 140 are disposed in concentric circles. Alternatively, when the compressing plate 110 has a rectangular shape, the first and second partition walls 120 and 130 and the sidewall 140 are disposed in concentric rectangles. Even if the compressing plate 110 has the rectangular shape, the first and second partition walls 120 and 130 and the sidewall 140 may still be disposed in concentric circles. The second partition wall 130 is combined with the supporter to divide a space between the first partition wall 120 and the sidewall 140 into two spaces.

The space between the first and second partition walls 120 and 130 is defined as a main pressure region MZ2 to which a second main pneumatic pressure MP2 for compressing the substrate is applied. The space between the second partition wall 130 and the sidewall 140 is defined as a peripheral pressure region MZ3 to which a third main pneumatic pressure MP3 for compressing the substrate is applied. That is, the substrate is held onto the first face 111 of the compressing plate 110 by the vacuum VP provided to the vacuum region MZ1. In addition, the substrate is adhered to the polishing pad by the first, second and third main pneumatic pressures MP1, MP2 and MP3 provided to the vacuum region MZ1, the main pressure region MZ2 and the peripheral pressure region MZ3, respectively.

To provide first, second and third auxiliary pressures AP1, AP2 and AP3 through the first and second partition walls 120 and 130 and the sidewall 140 to the compressing plate 110, respectively, the first, second and third pneumatic pressure-introducing portions are formed at the first and second partition walls 120 and 130 and the sidewall 140, respectively. The first pneumatic pressure-introducing portion includes the first slot 125 formed at the first partition wall 120, the second pneumatic pressure-introducing portion includes the second slot 135 formed at the second partition wall 130, and the third pneumatic pressure-introducing portion includes the third slot 145 formed at the sidewall 140. The first, second and third slots 125, 135 and 145 are formed from surfaces of the first and second partition walls 120 and 130 and the sidewall 140 to the second face of the compressing plate 110. The first, second and third slots 125, 135 and 145 extend in a direction in accordance with a longitudinal direction of the first and second partition walls 120 and 130 and the sidewall 140.

The first, second and third slots 125, 135 and 145 have annular shapes, respectively. Therefore, the first, second and third slots 125, 135 and 145 are disposed in concentric circles substantially similar to those of the first and second partition walls 120 and 130 and the sidewall 140. The first slot 125 divides the first partition wall 120 into a first inner wall 120*a* and a first outer wall 120*b*. The second slot 135 divides the second partition wall 130 into a second inner wall 130*a* and a second outer wall 130*b*. In addition, the third slot 145 divides the sidewall 140 into an inner sidewall 140*a* and an outer sidewall 140*b*.

First, second and third auxiliary region-forming members are formed at the first and second partition walls 120 and 130 and the sidewall 140, respectively. The first, second and third auxiliary region-forming members define first, second and third auxiliary pressure regions AZ1, AZ2 and AZ3, respectively. The first auxiliary pressure region-forming member includes a first partition plate formed on the first partition wall 120 to define the first auxiliary pressure region AZ1, the second auxiliary pressure region-forming member includes a second partition plate formed on the second partition wall 130 to define the second auxiliary pressure region AZ2, and the third auxiliary pressure region-forming member includes a third partition plate formed on the sidewall 140 to define the third auxiliary pressure region AZ3.

The first, second and third partition plates include first, second and third inner extending portions 121*a*, 131*a* and 141*a* horizontally extending from upper inner ends of the first and second partition walls 120 and 130 and the sidewall 140, respectively, first, second and third outer extending portions 121*b*, 131*b* and 141*b* horizontally extending from upper outer ends of the first and second partition walls 120 and 130 and the sidewall 140, respectively, first, second and third inner fencing portions 122*a*, 132*a* and 142*a* upwardly extending from ends of the first, second and third extending portions 121*a*, 131*a* and 141*a*, respectively, and first, second and third outer fencing portions 122*b*, 132*b* and 142*b* upwardly extending from ends of the first, second and third outer extending portions 121*b*, 131*b* and 141*b*, respectively. In particular, surfaces of the first, second and third inner extending portions 121*a*, 131*a* and 141*a* and surfaces of the first, second and third outer extending portions 121*b*, 131*b* and 141*b* are lower than those of the first and second partition walls 120 and 130 and the sidewall 140 so that step differences between the surfaces of the extending portions 121*a*, 121*b*, 131*a*, 131*b*, 141*a*, 141*b* and the surfaces of the walls 120, 130 and 140 are formed.

Upper ends of the first inner and outer fencing portions 122*a* and 122*b* are combined with the supporter to form a space surrounded by the first partition plate, the supporter and the surface of the first partition wall 120. This space is defined as the first auxiliary pressure region AZ1 to which the first auxiliary pneumatic pressure AP1 is applied.

Upper ends of the second inner and outer fencing portions 132*a* and 132*b* are combined with the supporter to form a space surrounded by the second partition plate, the supporter and the surface of the second partition wall 130. This space is defined as the second auxiliary pressure region AZ2 to which the second auxiliary pneumatic pressure AP2 is applied.

Upper ends of the third inner and outer fencing portions 142*a* and 142*b* are combined with the supporter to form a space surrounded by the third partition plate, the supporter and the surface of the sidewall 140. This space is defined as the third auxiliary pressure region AZ3 to which the third auxiliary pneumatic pressure AP3 is applied.

The first, second and third slots 125, 135 and 145 are formed from the surfaces of the first and second partition walls 120 and 130 and the sidewall 140 to the compressing plate 110. Thus, the first, second and third slots 125, 135 and 145 are in communication with the first, second and third auxiliary pressure regions AZ1, AZ2 and AZ3, respectively. As a result, the first, second and third auxiliary pressure regions AZ1, AZ2 and AZ3 have spaces expanded by volumes of the first, second and third slots 125, 135 and 145, respectively.

Each of the first, second and third slots 125, 135 and 145 has a depth substantially identical to each of heights of the first and second partition walls 120 and 130 and the sidewall 140. The first, second and third auxiliary pneumatic pressures AP1, AP2 and AP3 are directly provided to the second face 112 of the compressing plate 110 through the first, second and third slots 125, 135 and 145, respectively. Therefore, the first, second and third auxiliary pneumatic pressures AP1, AP2 and AP3 provided to the compressing plate 110 through the first, second and third auxiliary pressure regions AZ1, AZ2 and AZ3, respectively, are substantially identical to the first, second and third main pneumatic pressures MP1, MP2 and MP3 providing the compressing plate 110 through the vacuum region MZ1, the main pressure region MZ2 and the peripheral pressure region MZ3, respectively. Therefore, a uniform pressure is provided to the second face 112 of the compressing plate 110 so that the first face 111 of the compressing plate 110 uniformly adheres to the substrate on the polishing pad.

As shown in FIGS. 2 through 4, upper widths of the first, second and third slots 125, 135 and 145 are substantially identical to lower widths of the first, second and third slots 125, 135 and 145, respectively. Alternatively, to enlarge surface portions of the compressing plate 110 exposed through the first, second and third slots 125, 135 and 145, the first, second and third slots 125, 135 and 135 may have shapes that have gradually widening widths from an upper position to a lower position. In addition, the first, second and third slots 125, 135 and 145 may have dual structures that have, for example, a lower width wider than an upper width.

Figure 5:
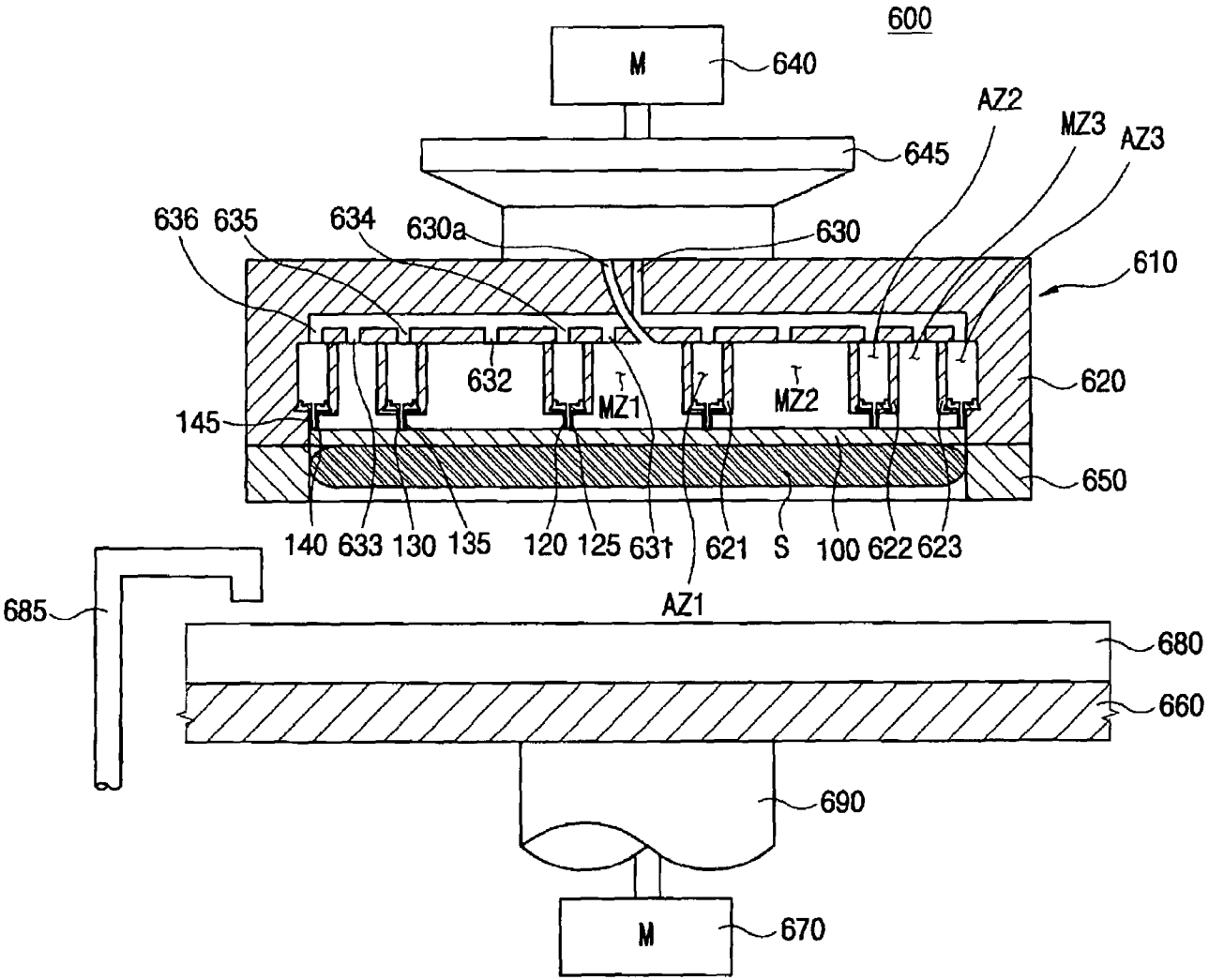
FIG. 5 is a cross sectional view illustrating a CMP apparatus having the flexible membrane of FIG. 2 in accordance with another preferred embodiment of the present invention.

FIG. 5 is a cross sectional view illustrating a CMP 600 apparatus having the flexible membrane 100 of FIG. 2 in accordance with another preferred embodiment of the present invention.

Referring to FIG. 5, the CMP apparatus 600 includes a platen 660 and a polishing head 610 disposed over the platen 660. A polishing pad 680 on which a substrate S is closely adhered is attached to a surface of the platen 660. The platen 660 is connected to a first motor 670 via a shaft 690. A slurry line 685 for providing slurry to a surface of the polishing pad 680 is disposed adjacent to the surface of the polishing pad 680.

The polishing head 610 includes a second motor 640, a supporter 620 connected to the second motor 640 via a shaft 645, the flexible membrane 100 supported by the supporter 620 for holding the substrate S, and a retainer ring 650 for preventing the substrate S held by the flexible membrane 100 from being detached.

As described above with reference to FIGS. 2 through 4, the flexible membrane 100 has the pneumatic pressure-introducing portions corresponding to the slots 125, 135 and 145. As like reference numerals refer to identical elements of the flexible membrane 100, further illustrations of the flexible membrane 100 and other elements in FIGS. 2 through 4 are omitted. The flexible membrane 100 is supported on a lower face of the supporter 620. The substrate S is held onto a lower face of the flexible membrane 100 and is closely adhered to the surface of the polishing pad 680.

The retainer ring 650 is mounted on an edge portion of the lower face of the supporter 620 to prevent the detachment of the substrate S from the flexible membrane 100 in a polishing operation.

The supporter 620 has a structure that includes a space for receiving the flexible membrane 100 therein. Further, the supporter 620 includes first and second partition wall-supporting portions 621 and 622 for supporting the first and second partition walls 120 and 130 of the flexible membrane 100, and a sidewall-supporting portion 623 for supporting the sidewall 140 of the flexible membrane 100.

The vacuum region MZ1 is defined by the first partition wall 120, the first partition wall-supporting portion 621, the lower face of the supporter 620 and the surface of the compressing plate 110. The main pressure region MZ2 is defined by the first and second partition walls 120 and 130, the first and second partition wall-supporting portions 621 and 622, the lower face of the supporter 620 and the surface of the compressing plate 110. In addition, the peripheral pressure region MZ3 is defined by is the second partition wall 130, the sidewall 140, the second partition wall-supporting portion 622, the sidewall-supporting portion 623, the lower face of the supporter 620 and the surface of the compressing plate 110.

The first auxiliary pressure region AZ1 is defined by the surface of the first partition wall 120, the first partition plate and the lower face of the supporter 620. The second auxiliary pressure region AZ2 is defined by the surface of the second partition wall 130, the second partition plate and the lower face of the supporter 620. In addition, the third auxiliary pressure region AZ3 is defined by the surface of the sidewall 140, the third partition plate and the lower face of the supporter 620.

A first passageway 630 for providing the pneumatic pressures MP1, MP2, MP3, AP1, AP2 and AP3 to the regions MZ1, MZ2, MZ3, AZ1, AZ2 and AZ3, respectively, is formed through the supporter 620. The first passageway 630 diverges into first, second and third main passageways 631, 632 and 633 for providing the first, second and third main pneumatic pressures MP1, MP2 and MP3 to the vacuum region MZ1, the main pressure region MZ2 and the peripheral pressure region MZ3, respectively, and first, second and third auxiliary passageways 634, 635 and 636 for providing the first, second and third auxiliary pneumatic pressures AP1, AP2 and AP3 to the auxiliary pressure regions AZ1, AZ2 and AZ3, respectively.

A second passageway 630*a* for providing the vacuum VP for holding the substrate S onto the vacuum region MZ1 is formed through the supporter 620. The substrate S is adhered to the lower face of the compressing plate 110 by the vacuum VP that is provided to the vacuum region MZ1 through the second passageway 630*a*.

The pneumatic pressures MP1, MP2, MP3, AP1, AP2 and AP3 are provided to the regions MZ1, MZ2, MZ3, AZ1, AZ2 and AZ3 through the first passageway 630. In particular, the first, second and third main pneumatic pressures MP1, MP2 and MP3 are directly provided to the surface of the compressing plate 110 through the first, second and third main passageways 631, 632 and 633. The first, second and third auxiliary pneumatic pressures AP1, AP2 and AP3 are directly provided to the surface of the compressing plate 110 through the first, second and third auxiliary passageways 634, 635, and 636.

The substrate S is uniformly adhered to the polishing pad 680 by the main and auxiliary pneumatic pressures MP1, MP2, MP3, AP1, AP2 and AP3. The slurry is then provided to the surface of the polishing pad 680 from the slurry line 685. The first motor 670 rotates the polishing pad 680 in a first direction, for example, in a clockwise direction. In addition, the second motor 640 rotates the polishing head 610 in a second direction opposite to the first direction, for example, in a counterclockwise direction. Thus, the substrate S is rotated and simultaneously compressed on the polishing pad 680, thereby polishing the surface of the substrate S to a uniform thickness.

In an experiment, polishing characteristics of a flexible membrane having a size of about 200 mm without pneumatic pressure-introducing portions and the flexible membrane 100 of FIG. 2 were compared to each other.

Figure 6:
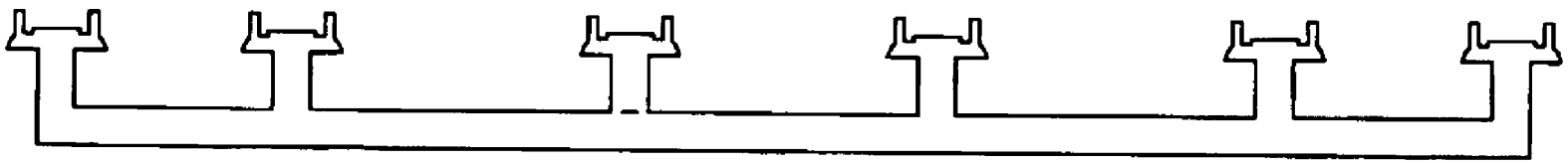
FIG. 6 is a cross sectional view illustrating a conventional flexible membrane corresponding to the flexible membrane of FIG. 2.

To compare the polishing characteristics between the flexible membranes, a flexible membrane 1000 without the pneumatic pressure-introducing portions shown in FIG. 6 was manufactured. The flexible membrane 1000 had a size and a configuration substantially identical to that of the flexible membrane 100 except that the flexible membrane 1000 did not have the pneumatic pressure-introducing portions. The flexible membrane 1000 and the flexible membrane 100 were employed in the CMP apparatus 600 of FIG. 5.

In order to form a layer to be polished, an oxide layer having a thickness of about 6,000 Å was formed on a semiconductor substrate having a size of about 200 mm. A tantalum layer having a thickness of about 250 Å was formed on the oxide layer. A seed layer including copper and having a thickness of about 1,500 Å was formed on the tantalum layer. A copper layer having a thickness of about 14,000 Å was then formed on the seed layer using an electroplating method. Two semiconductor substrates having the above structure were then prepared.

Pneumatic pressures for polishing were applied to the flexible membranes 100 and 1000, respectively, and were measured. The measured pneumatic pressures are shown in following Table 1.

TABLE 1

| | | Region | | | | | |
|---|---|---|---|---|---|---|---|
| | | MZ1 | MZ2 | MZ3 | AZ1 | AZ2 | AZ3 |
| Pneumatic pressure (psi) | Flexible membrane 1000 | 2.8 | 2.45 | 2.6 | 4.0 | 3.5 | 2.0 |
| | Flexible membrane 100 | 2.4 | 2.23 | 2.3 | 2.0 | 1.8 | 1.0 |

As shown in Table 1, in the flexible membrane 1000 the first main pneumatic pressure MP1 provided to the vacuum region MZ1 is 2.8 psi, the second main pneumatic pressure MP2 provided to the main pressure region MZ2 is 2.45 psi, and the third main pneumatic pressure MP3 provided to the peripheral pressure region MZ3 is 2.6 psi. In addition, the first auxiliary pneumatic pressure AP1 provided to the first auxiliary pressure region AZ1 is 4.0 psi, the second auxiliary pneumatic pressure AP2 provided to the second auxiliary pressure region AZ2 is 3.5 psi, and the third auxiliary pneumatic pressure AP3 provided to the third auxiliary pressure region is 2.0 psi.

According to the above measurements, it can be observed that the auxiliary pneumatic pressures AP1, AP2 and AP3 in the auxiliary pressure regions AZ1, AZ2 and AZ3 in the flexible membrane 1000 were very different from each other. On the contrary, as shown in Table 1, in the flexible membrane 100 the first main pneumatic pressure MP1 provided to the vacuum region MZ1 is 2.4 psi, the second main pneumatic pressure MP2 provided to the main pressure region MZ2 is 2.23 psi, and the third main pneumatic pressure MP3 provided to the peripheral pressure region MZ3 is 2.3 psi. In addition, the first auxiliary pneumatic pressure AP1 provided to the first auxiliary pressure region AZ1 is 2.0 psi, the second auxiliary pneumatic pressure AP2 provided to the second auxiliary pressure region AZ2 is 1.8 psi, and the third auxiliary pneumatic pressure AP3 provided to the third auxiliary pressure region is 1.0 psi.

Thus, according to the above measurements, it can be observed that the auxiliary pneumatic pressures AP1, AP2 and AP3 in the auxiliary pressure regions AZ1, AZ2 and AZ3 were lower than the main pneumatic pressures MP1, MP2 and MP3 in the vacuum region MZ1, the main pressure region MZ2 and the peripheral pressure region MZ3, respectively, in the flexible membrane 100.

Polishing processes were also performed on the two semiconductor substrates using the CMP apparatuses having the flexible membranes 100 and 1000. Here, an abrasive-free slurry was used as an abrasive. A rotational speed of the polishing head was about 23 rpm and a rotational speed of the platen was about 600 rpm. In addition, the polishing processes were performed for about 90 seconds.

Figure 7A:
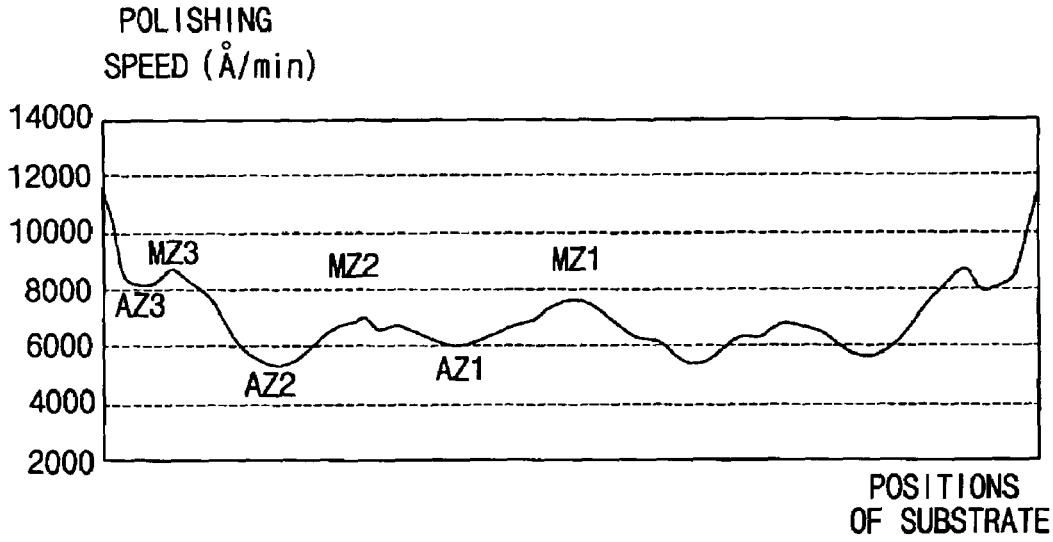
FIG. 7A is a graph showing polishing speeds at local regions of a semiconductor substrate when a copper layer on the semiconductor substrate is polished using the flexible membrane of FIG. 6.
Figure 7B:
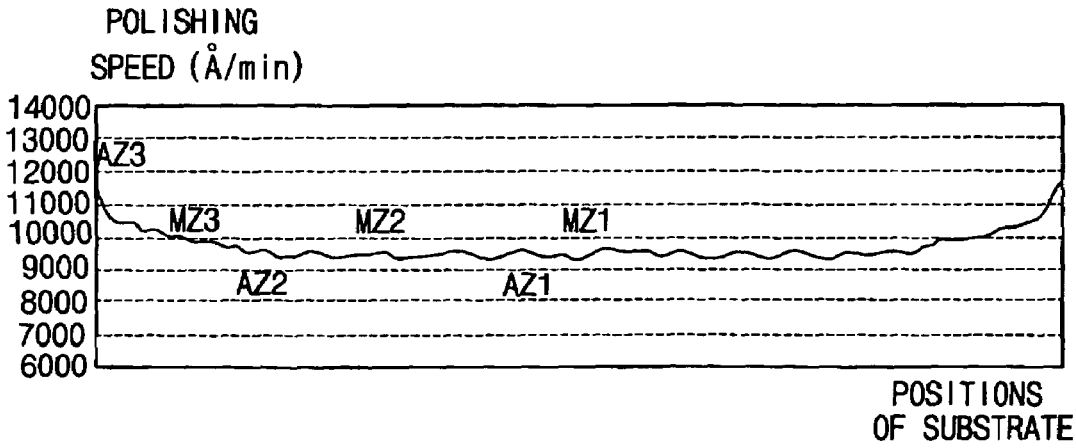
FIG. 7B is a graph showing polishing speeds at local regions of a semiconductor substrate when a copper layer on the semiconductor substrate is polished using the flexible membrane of FIG. 2.

FIG. 7A is a graph showing polishing speeds at positions of a semiconductor substrate when a copper layer on the semiconductor substrate is polished using the flexible membrane 1000 of FIG. 6. FIG. 7B is a graph showing polishing speeds at positions of a semiconductor substrate when a copper layer on the semiconductor substrate is polished using the flexible membrane 100 of FIG. 2. In FIGS. 7A and 7B, a horizontal axis represents positions of the substrate and a vertical axis represents a polishing speed.

As shown in FIG. 7A, a polishing speed with respect to portions of the substrate, which correspond to the vacuum region MZ1, the main pneumatic pressure region MZ2 and the peripheral pneumatic pressure region MZ3, was about 8,000 Å/min. A polishing speed with respect to portions of the substrate, which correspond to the first and second auxiliary pressure regions AZ1 and AZ2, was about 6,000 Å/min. A polishing speed with respect to a portion of the substrate, which corresponds to the third auxiliary pressure region, was about 11,000 Å/min.

The polishing speeds between the main pressure regions MZ1, MZ2 and MZ3 and the auxiliary pressure regions AZ1, AZ2 and AZ3 were very different from each other. This was due to the measured pneumatic pressures. For example, the pneumatic pressures in the auxiliary pressure regions AZ1, AZ2 and AZ3 were considerably different from those in the vacuum region MZ1, the main pressure region MZ2 and the peripheral pressure region MZ3. In addition, the pneumatic pressures in the auxiliary pressure regions AZ1, AZ2 and AZ3 were different from each other. As a result, the flexible membrane 1000 does not always uniformly compress the substrate on the polishing pad.

On the contrary, as shown in FIG. 7B, polishing speeds were about 9,500 Å/min to about 10,000 Å/min in all the regions except the third auxiliary pressure region AZ3 in which a polishing speed was no less than about 11,000 Å/min.

The auxiliary pneumatic pressures applied to the auxiliary pressure regions AZ1, AZ2 and AZ3 were substantially similar to each other and were also little different from the main pneumatic pressures applied to the main pressure regions MZ1, MZ2 and MZ3. Therefore, the flexible membrane 100 in accordance with the present invention uniformly compresses the substrate on the polishing pad so that the CMP apparatus having the flexile membrane 100 can polish the substrate to a uniform thickness.

In another experiment regarding polishing characteristics of the flexible membrane 100, a fluorine doped silicate glass (FSG) having a thickness of about 3,000 Å was deposited on a semiconductor substrate.

A polishing process was performed on the substrate using the flexible membrane 100 for about 90 seconds. In this polishing process, a silica-based slurry was used as an abrasive. A rotational speed of the polishing head was about 23 rpm and a rotational speed of the platen was about 300 rpm.

Figure 8:
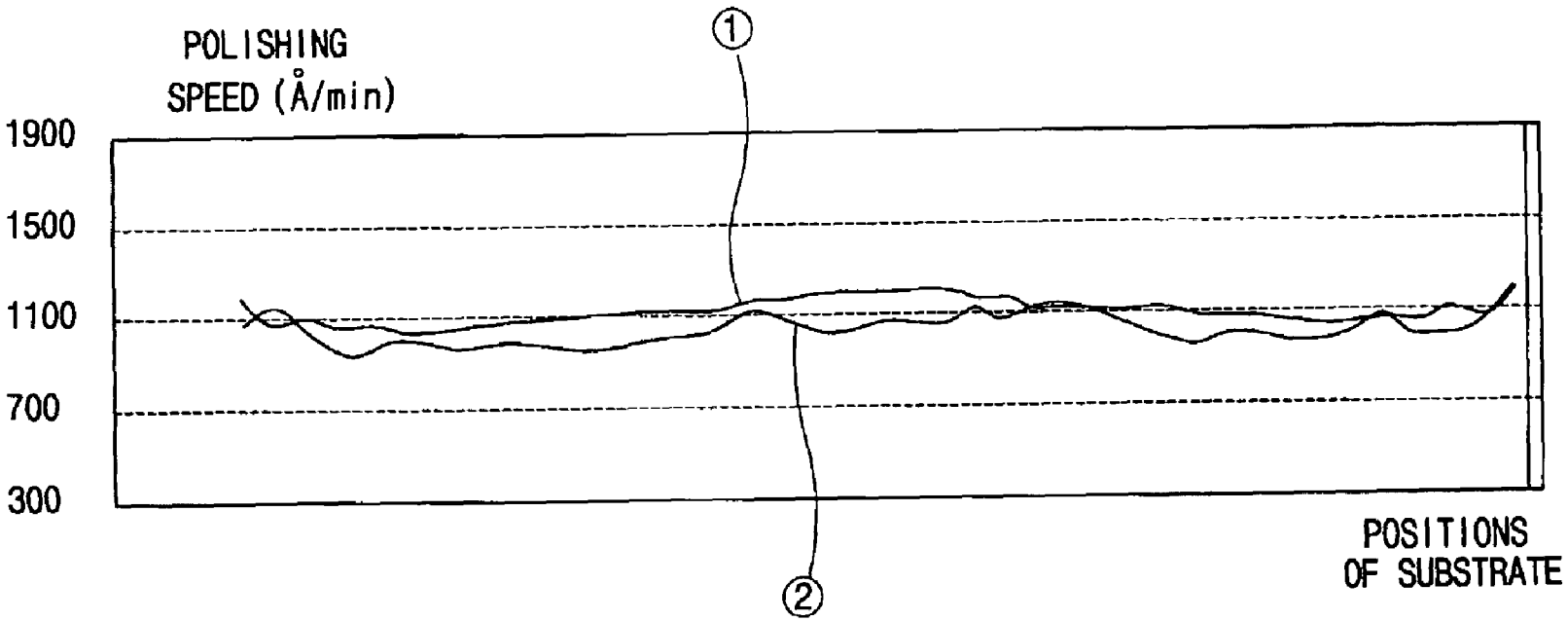
FIG. 8 is a graph showing polishing speeds at local regions of a semiconductor substrate when an oxide layer on the semiconductor substrate is polished using the flexible membrane of FIG. 2.

FIG. 8 is a graph showing polishing speeds at positions of a semiconductor substrate when an FSG layer on the semiconductor substrate is polished using the flexible membrane 100. In FIG. 8, line ① represents a desired target polishing speed and line ② represents an actual polishing speed.

As shown in FIG. 8, when the substrate was polished using the CMP apparatus having the flexible membrane 100, the actual polishing speed was substantially identical or similar to the target polishing speed. In addition, the actual polishing speeds at certain positions of the substrate were substantially similar to each other.

Thus, the CMP apparatus having the flexible membrane 100 polished the substrate to a uniform thickness. As a result, the flexible membrane 100 closely adhered the substrate to the polishing pad.

According to a preferred embodiment of present invention, the pneumatic pressure-introducing portions are formed at the dividing member and the sidewall so that the pneumatic pressure is directly provided to the portions of the compressing plates under the dividing member and the sidewall. Thus, because the uniform pneumatic pressure is applied to the compressing plate, the compressing plate closely adheres the substrate to the polishing pad. As a result, the substrate may be polished to a uniform thickness.

Having described the preferred embodiments of the present invention, it is noted that modifications and variations can be made by persons of ordinary skill in the art in light of the above teachings. It is therefore to be understood that various changes, substitutions and alterations may be made herein without departing from the scope and the spirit of the invention as outlined by the appended claims.

What is claimed is:

1. A flexible membrane for a polishing head comprising:

a compressing plate having a first face for holding and compressing a substrate and a second face opposite to the first face, wherein a first pneumatic pressure for compressing the substrate is provided to the second face; and a dividing member formed on the second face for dividing the second face into at least two regions, the dividing member including a first pneumatic pressure-introducing portion for introducing a second pneumatic pressure onto the second face.

2. The flexible membrane of claim 1, wherein the dividing member further comprises:

a first partition wall disposed on a central portion of the second face, the first partition wall defining a vacuum region to which a vacuum for holding the substrate is applied; and a second partition wall disposed on a portion of the second face outside the first partition wall, the second partition wall defining a main pressure region into which the first pneumatic pressure is introduced.

3. The flexible membrane of claim 1, further comprising:

a sidewall disposed on an edge portion of the second face.

4. The flexible membrane of claim 3, further comprising:

a second pneumatic pressure-introducing portion for introducing a third pneumatic pressure onto the edge portion of the second face formed at the sidewall.

5. The flexible membrane of claim 1, wherein the second pneumatic pressure is less than the first pneumatic pressure.

6. The flexible membrane of claim 1, wherein the first pneumatic pressure-introducing portion comprises a slot formed at a surface portion of the dividing member.

7. The flexible membrane of claim 6, wherein the slot is arranged in a direction in accordance with a longitudinal direction of the dividing member.

8. The flexible membrane of claim 6, wherein the slot has a depth substantially identical to a height of the dividing member.

9. The flexible membrane of claim 1, wherein the compressing plate and the dividing member comprise one of an ethylene propylene rubber, a neoprene rubber and a nitrile rubber.

10. The flexible membrane of claim 1, wherein the dividing member comprises:

an inner wall;

an outer wall facing the inner wall, the inner and outer walls defining the first pneumatic pressure-introducing portion;

an inner extending portion horizontally extending from an upper end of the inner wall to a central portion of the compressing plate;

an outer extending portion horizontally extending from an upper end of the outer wall to an edge portion of the compressing plate;

an inner fencing portion upwardly extending from an end of the inner extending portion; and an outer fencing portion upwardly extending from an end of the outer extending portion.

11. The flexible membrane of claim 1, wherein each of the first and second partition walls comprises:

an inner wall;

an outer wall facing the inner wall, the inner and outer walls defining the first and second pneumatic pressure-introducing portions;

an inner extending portion horizontally extending from an upper end of the inner wall to a central portion of the compressing plate;

an outer extending portion horizontally extending from an upper end of the outer wall to an edge portion of the compressing plate;

an inner fencing portion upwardly extending from an end of the inner extending portion; and an outer fencing portion upwardly extending from an end of the outer extending portion.

12. A flexible membrane for a polishing head comprising:

a compressing plate having a first face for holding a substrate and a second face opposite to the first face with a vacuum and for compressing with a first main pneumatic pressure the substrate and the second face, wherein the vacuum and the first main pneumatic pressure are selectively provided to the second face; and a first partition wall formed on a central portion of the second face to define a vacuum region to which the vacuum and the first main pneumatic pressure are selectively applied, the first partition wall having a first pneumatic pressure-introducing portion for introducing a first auxiliary pneumatic pressure onto the second face;

a second partition wall formed between the central portion and an edge portion of the second face to define a main pressure region with the first partition wall to which a second main pneumatic pressure is applied, the second partition wall having a second pneumatic pressure-introducing portion for introducing a second auxiliary pneumatic pressure onto the second face; and a sidewall formed on the edge portion of the second face to define a peripheral pressure region with the second partition wall to which a third main pneumatic pressure is applied.

13. The flexible membrane of claim 12, further comprising:

a third pneumatic pressure-introducing portion for introducing a third auxiliary pneumatic pressure onto the edge portion of the second face formed at the sidewall.

14. The flexible membrane of claim 12, wherein the first auxiliary pneumatic pressure is less than the first main pneumatic pressure and the second auxiliary pneumatic pressure is less that the second main pneumatic pressure.

15. The flexible membrane of claim 12, wherein the first and second pneumatic pressure-introducing portions comprise slots formed from surfaces of the first and second partition walls to the second face of the compressing plate, wherein the slots extend in a direction oriented to lengths of the first and second partition walls.

16. The flexible membrane of claim 12, wherein the compressing plate and the dividing member each comprises one of an ethylene propylene rubber, a neoprene rubber and a nitrile rubber.

17. A chemical mechanical polishing (CMP) apparatus comprising:

a platen having a pad for polishing a substrate; and a polishing head disposed over the platen, the polishing head including a flexible membrane for holding and compressing the substrate on the polishing pad and a supporter for supporting the flexible membrane, wherein the flexible membrane comprises:

a compressing plate having a first face for holding and compressing the substrate and a second face opposite to the first face, wherein a first pneumatic pressure for compressing the substrate is provided to the second face; and a dividing member formed on the second face for dividing the second face into at least two regions, the dividing member including a first pneumatic pressure-introducing portion for introducing a second pneumatic pressure onto the second face.

18. The apparatus of claim 17, wherein the dividing member further comprises:

a first partition wall disposed on a central portion of the second face, the first partition wall defining a vacuum region to which a vacuum for holding the substrate is applied; and a second partition wall disposed on a portion of the second face outside the first partition wall, the second partition wall defining a main pressure region to which the first pneumatic pressure is applied.

19. The apparatus of claim 17, further comprising:

a sidewall disposed on an edge portion of the second face, the sidewall having a second pneumatic pressure-introducing portion for introducing a third pneumatic pressure onto the edge portion of the second face.

20. The apparatus of claim 17, wherein the first pneumatic pressure-introducing portion comprises a slot formed at a surface portion of the dividing member.

* * * * *